US008033259B2

(12) United States Patent
Ishikawa

(10) Patent No.: US 8,033,259 B2
(45) Date of Patent: Oct. 11, 2011

(54) ROCKER ARM FOR INTERNAL COMBUSTION ENGINE

(75) Inventor: Shizuo Ishikawa, Nishio (JP)

(73) Assignee: Otics Corporation, Nishio-Shi, Aichi (JP)

( * ) Notice: Subject to any disclaimer, the term of this patent is extended or adjusted under 35 U.S.C. 154(b) by 35 days.

(21) Appl. No.: 12/654,611

(22) Filed: Dec. 24, 2009

(65) Prior Publication Data

US 2010/0180846 A1 Jul. 22, 2010

(30) Foreign Application Priority Data

Jan. 19, 2009 (JP) ..... 2009-008825

(51) Int. Cl.
*F01M 1/06* (2006.01)
*F01L 1/18* (2006.01)

(52) U.S. Cl. ..... 123/90.33; 123/90.39; 74/559

(58) Field of Classification Search ..... 123/90.33, 123/90.36, 90.39, 90.44, 90.45, 90.46; 74/559; 29/888.2
See application file for complete search history.

(56) References Cited

U.S. PATENT DOCUMENTS

| | | | | | |
|---|---|---|---|---|---|
| 2,572,968 | A | * | 10/1951 | Bachle | 123/90.38 |
| 3,314,404 | A | * | 4/1967 | Thompson | 123/90.43 |
| 3,400,696 | A | * | 9/1968 | Thompson | 123/90.27 |
| 4,825,717 | A | | 5/1989 | Mills | |
| 5,325,825 | A | | 7/1994 | Schmidt et al. | |
| 5,657,726 | A | * | 8/1997 | Diggs | 123/90.36 |
| 6,070,561 | A | * | 6/2000 | Greene et al. | 123/90.36 |
| 2008/0257293 | A1 | * | 10/2008 | Fasanotto | 123/90.36 |
| 2009/0126665 | A1 | * | 5/2009 | Edgar | 123/90.39 |

FOREIGN PATENT DOCUMENTS

| | | | |
|---|---|---|---|
| DE | 42 34 868 | | 4/1994 |
| FR | 2 878 282 | | 5/2006 |
| JP | 2001317311 | A * | 11/2001 |
| JP | 2002-161717 | | 6/2002 |
| JP | 2004-52637 | | 2/2004 |
| JP | 2005-155569 | | 6/2005 |

OTHER PUBLICATIONS

Extended European Search Report mailed on Mar. 23, 2010 for EP 09 01 5203.

* cited by examiner

*Primary Examiner* — Thomas Denion
*Assistant Examiner* — Daniel Bernstein
(74) *Attorney, Agent, or Firm* — Smith, Gambrell & Russell, LLP

(57) ABSTRACT

A rocker arm includes a roller brought into contact with a cam to be rotated and an arm body having a storage portion for the roller. The storage portion has an opening edge including a part receiving lubricant oil flowing along an upper surface of the arm body. The part is formed with a receiving opening edge jutting out so that both widthwise ends are located away from a circumferential surface of the roller and so that a widthwise central portion comes closer to the circumferential surface of the roller. The arm body has a lubricant guide path formed by recessing the upper surface thereof and guiding the lubricant oil into the storage portion. The lubricant guide path has a width that is gradually rendered larger as the lubricant guide path gets close to the widthwise central portion of the receiving opening edge.

10 Claims, 5 Drawing Sheets

ROCKER ARM FOR INTERNAL COMBUSTION ENGINE

CROSS-REFERENCE TO RELATED APPLICATIONS

This application is based on and claims the benefit of priority from the prior Japanese Patent Application No. 2009-8825, filed on Jan. 19, 2009, the entire contents of which are incorporated herein by reference.

BACKGROUND

1. Field

The present invention relates to a rocker arm provided in an internal combustion engine for opening and closing a valve.

2. Related Art

Japanese patent application publication JP-A-2002-161717 discloses a conventional rocker arm of the above-described type having an arm body which is elongate in a front-back direction. The arm body has a front end formed with a valve abutting portion on which a valve is caused to abut and a rear end formed with a support receiving portion which is supported on an upper end of a pivot mounted on a cylinder head. The arm body further has a middle portion formed with a storage portion in which a roller is stored.

When a roller is driven by a cam which abuts on the roller, the rocker arm is swung with an upper end of the pivot serving as a fulcrum, whereby the valve is lifted. In this case, the upper end of the pivot is formed with a concave sphere, and the support receiving portion has an underside formed with a convex sphere. The concave sphere of the pivot acts as a receiving pan which receives lubricant oil, reserving the lubricant oil. The lubricant oil lubricates surfaces of both concave and convex spheres so that sliding friction between the rocker arm and the pivot can be reduced.

Peripheral or circumferential surfaces of the roller and the cam also need to be lubricated with lubricant oil for reduction in the sliding friction between the roller and the cam. In this case, for example, a flow path is formed in an upper surface of the arm body so that the lubricant oil flows therethrough toward the roller storage portion. The aforesaid gap is defined between an opening edge of the roller storage portion and a circumferential surface of the roller. The lubricity of the lubricant oil needs to be improved by reducing the gap. However, as shown in FIG. 5, a roller 4 has a peripheral surface further having both widthwise end corners to which parts A of an opening edge 3 are opposed respectively. When the opening edge 3 of the roller storage portion is to be formed along an outer edge of the roller 4 while the aforesaid gap is reduced, each part A needs to be formed so as to have such a small radius that each part A makes a right angle. Accordingly, it is difficult to improve a machining accuracy of each part A.

On the other hand, the machinability can be improved when the aforesaid gap between the roller storage portion and the roller 4 is wholly increased. In this case, however, there is a case where the lubricant oil cannot reach the circumferential surface of the roller 4. Accordingly, increasing the aforesaid gap is undesirable. More specifically, the machinability of the rocker arm 2 is reduced when preference is given to the lubricity between the roller 4 and the cam, whereas the lubricity between the roller 4 and the cam is reduced when preference is given to the machinability of the rocker arm 2. Thus, it is difficult to satisfy both lubricity and machinability at the same time.

SUMMARY

Therefore, an object of the present invention is to provide a rocker arm for an internal combustion engine, which can improve the machinability of the rocker arm.

According to one aspect of the present invention, there is provided a rocker arm for an internal combustion engine, comprising a roller brought into contact with a cam thereby to be rotated; and an arm body having a storage portion in which the roller is stored, the arm body being swung by rotation of the cam, thereby opening and closing a valve, wherein the storage portion has an opening edge located on an upper surface of the arm body and opposed to a circumferential surface of the roller, and the opening edge includes a part receiving lubricant oil flowing along the upper surface of the arm body, said part being formed with a receiving opening edge jutting out so that both widthwise ends thereof are located away from the circumferential surface of the roller and so that a widthwise central portion thereof comes closer to the circumferential surface of the roller; and wherein the arm body has a lubricant guide path which is formed by recessing the upper surface thereof and guides the lubricant oil into the storage portion, the lubricant guide path having a width that is gradually rendered larger as the lubricant guide path gets close to the widthwise central portion of the receiving opening edge.

DETAILED DESCRIPTION

Figure 1:
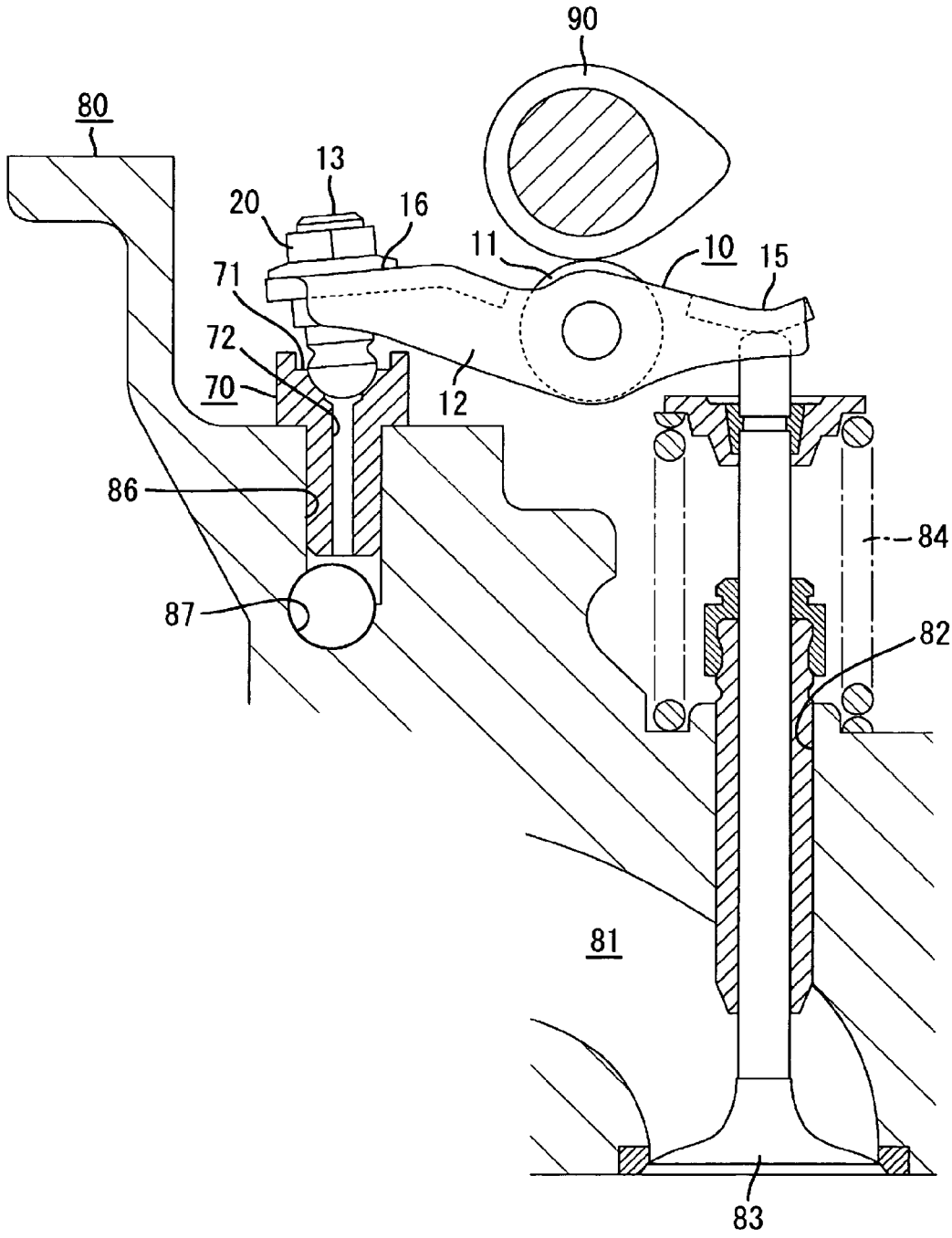
FIG. 1 is a sectional view of a valve gear incorporating a rocker arm of one embodiment in accordance with the present invention.

One embodiment will be described with reference to FIGS. 1 to 4 of the accompanying drawings. A valve gear for an internal combustion engine will firstly be described. Referring to FIG. 1, a cylinder head 80 of the internal combustion engine is formed with a fluid channel 81 (an air intake or exhaust port) and a stem aperture 82 which communicates with the fluid channel 81 and is open in an upper surface of the cylinder head 80. A valve 83 (an air intake or exhaust valve) is incorporated in the stem aperture 82 so as to be vertically reciprocable between a valve opening position and a valve closing position, thereby opening and closing a vent hole confronting the fluid channel 81. The valve 83 is normally urged in a valve closing direction (upward) by a valve spring 84. The valve 83 has an upper end protruding upward from an upper end opening of the stem aperture 82.

A generally oval cam 90 is located above the cylinder head 80 so as to be rotatable. The cylinder head 80 has a mounting recess 86 formed in the upper surface thereof. A pivot 70 is mounted in the mounting recess 86. The cylinder head 80 further has a lubricant supply hole 87 which is formed so as to extend therein. Lubricant oil flows through the lubricant supply hole 87. A middle part of the lubricant supply hole 87 is open to the bottom of the mounting recess 86.

The pivot 70 is formed into a circular cylindrical shape on the whole and press-fitted or screwed into the mounting recess 86 with an axis line thereof being vertically directed. The pivot 70 has an upper end surface formed with a concave spherical support portion 71 in which a head 19 of an adjust screw 13 of the rocker arm 10 is fitted as will be described later. The pivot 70 has an inter-pivot lubricant guide hole 72 which is formed so as to extend vertically through a shaft center thereof. The lubricant oil supplied from the lubricant supply hole 87 is guided through the inter-pivot lubricant guide hole 72. The lubricant is spouted onto the head 19 of the adjust screw 13 after having flowed upward through the inter-pivot lubricant guide hole 72. As a result, the lubricant oil is stored in the support portion 71 thereby to lubricate the rocker arm 10 and the pivot 70.

Figure 2:
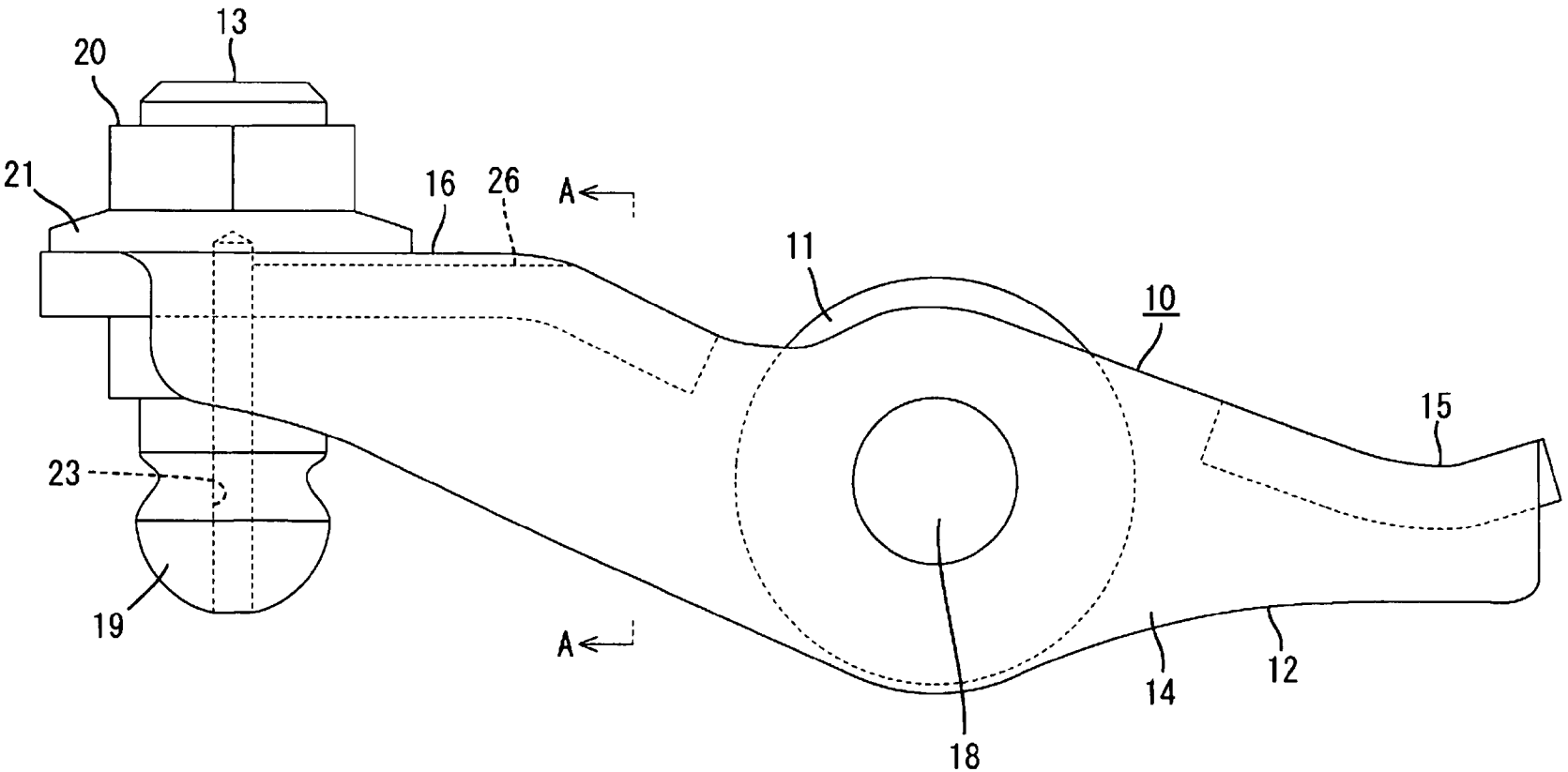
FIG. 2 is a side view of the rocker arm.
Figure 3:
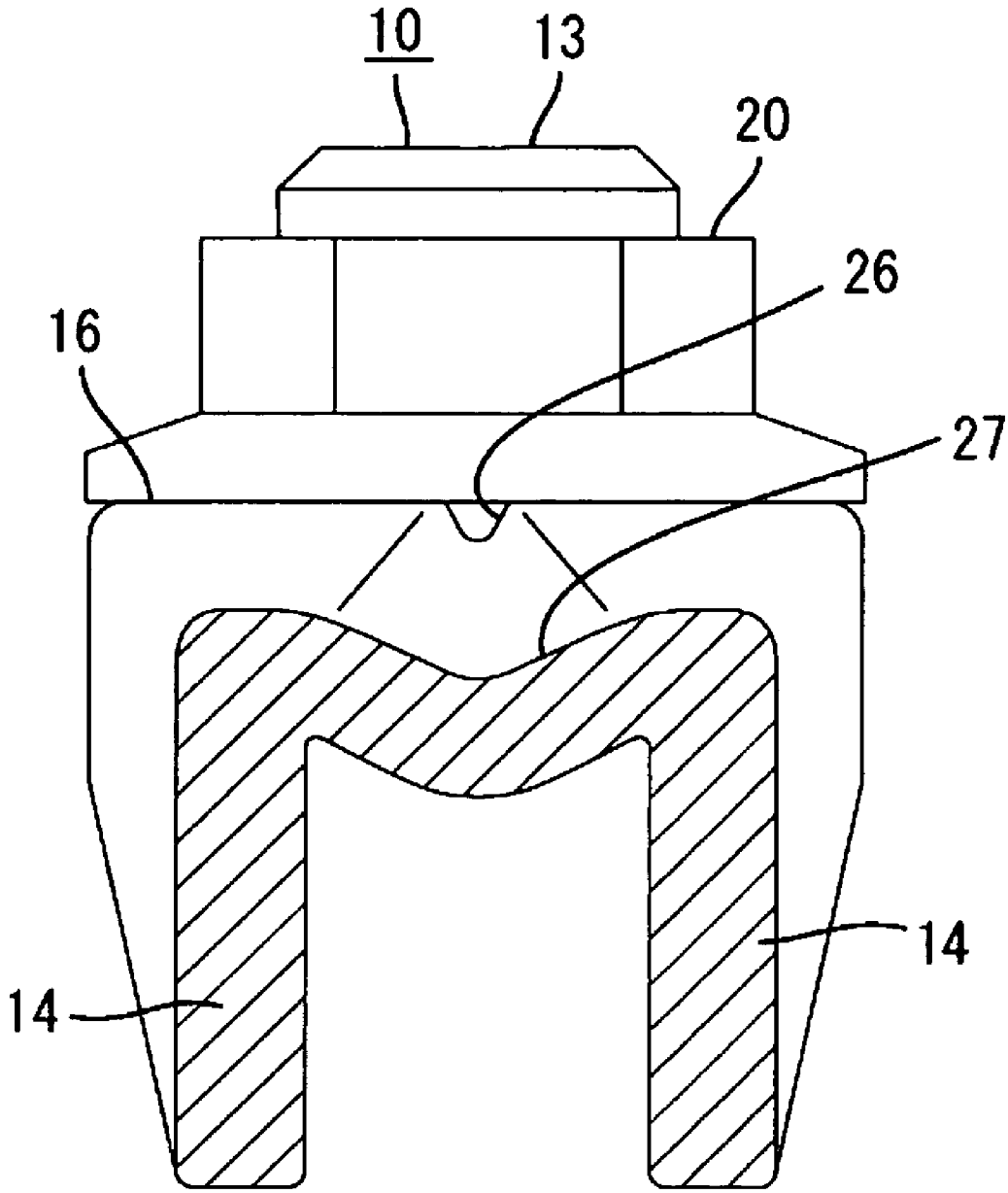
FIG. 3 is a sectional view taken along line A-A in FIG. 2.
Figure 4:
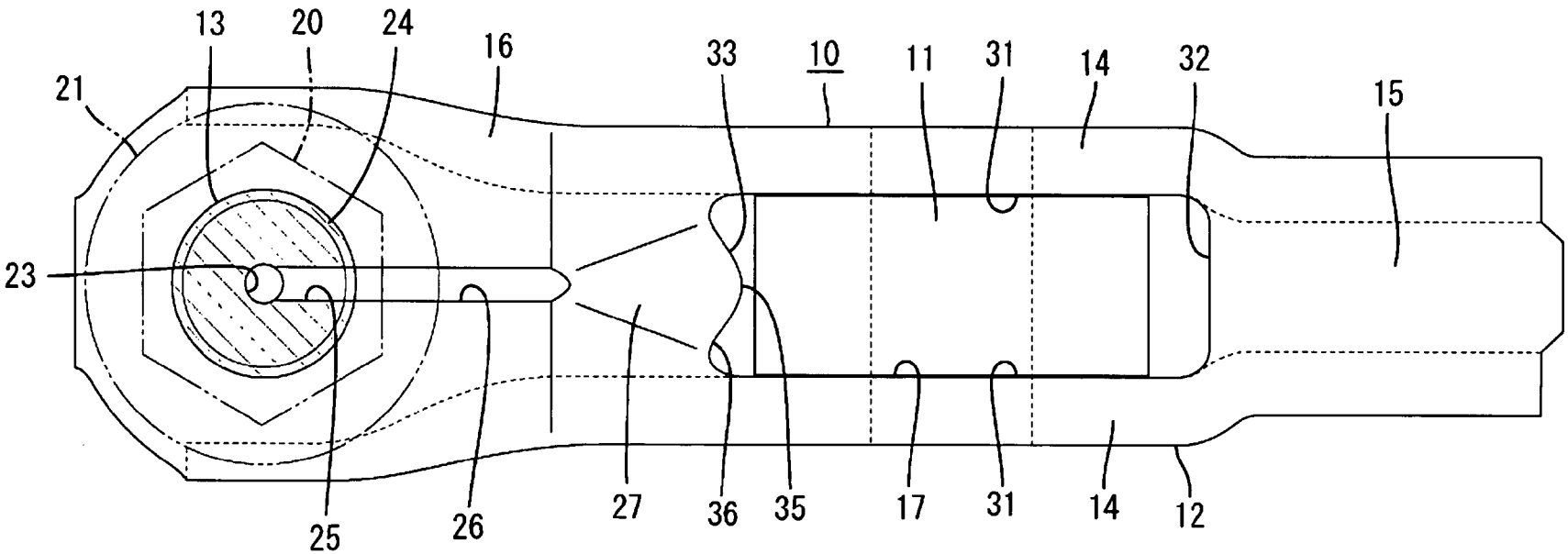
FIG. 4 is a plan view of the rocker arm.
Figure 5:
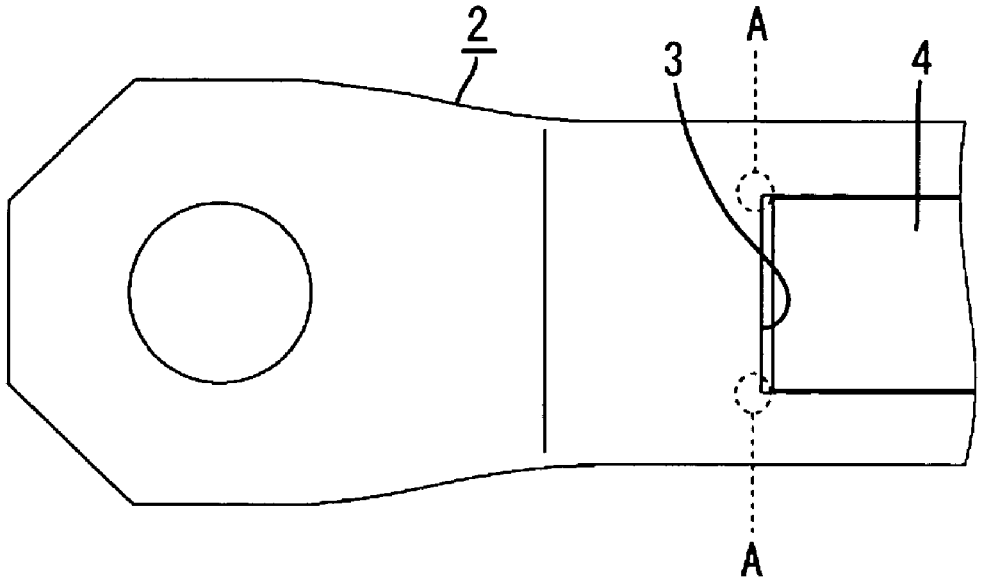
Fig. 5 RELATED ART
FIG. 5 is a partial plan view of a conventional rocker arm.

The rocker arm 10 further includes a cylindrical roller 11 which abuts on the cam 90 from above, an arm body 12 which is elongate in the front-back direction (the direction in which the valve 83 and the pivot 70 are connected with each other by an imaginary line), and the aforesaid adjust screw 13 to be mounted on the arm body 12, as shown in FIG. 2.

The arm body 12 includes a pair of widthwise opposed sidewalls 14, a valve abutting portion 15 formed by connecting front ends of the sidewalls 14 together and abutting on an upper end of the valve 83, a support receiving portion 16 formed by connecting rear ends of the sidewalls 14 and receiving the upper end of the pivot 70, and a storage portion 17 which is located between the valve abutting portion 15 and the support receiving portion 16 and in which the roller 11 is stored so as to extend through the support receiving portion 16. The roller 11 is rotatable about a support shaft 18 parallel to a rotational central axis of the cam 90. The roller 11 has an upper end which is disposed so as to protrude higher than the upper end of the arm body 12. The cam 90 is adapted to be slid on the upper end of the roller 11.

The support receiving portion 16 has a female threaded hole (not shown) which is formed so as to vertically extend therethrough. The adjust screw 13 is threadingly engaged in the female threaded hole. The adjust screw 13 includes a male thread 24 and a head 19 which is formed integrally with the male thread 24 so as to bulge from a lower end of the thread 24. The head 19 has an outer circumferential surface which is formed into a convex spherical shape fitted into the support portion 71 thereby to serve as a sliding surface which is brought into sliding engagement with the support portion 71. The male thread 24 is threadingly engaged into the female threaded hole, the level of the head 19 is adjusted by changing a depth of thread engagement of the male thread 24 into the female thread.

A lock nut 20 is mounted on the upper surface of the support receiving portion 16 so as to be located about an opening edge of the female threaded hole. The lock nut 20 is threadingly engaged with the male thread 24 of the adjust screw 13 thereby to serve to hold the adjust screw 13 in a rotation limited state relative to the arm body 12 upon the tightening. The lock nut 20 has a flange 21 formed on the entire lower outer circumference thereof. The flange 21 is located so as to cover an opening edge of the female threaded hole on the upper surface of the support receiving portion 16.

The adjust screw 13 has a vertical lubricant guide bore 23 which extends vertically along the axial center thereof and opens at a lower end thereof. The adjust screw 13 also has a horizontal lubricant guide bore 25 which extends radially (in the front-back direction) beneath the flange 21. The vertical lubricant guide bore 23 communicates with the inter-pivot lubricant guide hole 72 to receive the lubricant from the inter-pivot lubricant guide hole 72. The horizontal lubricant guide bore 25 extends in a direction perpendicular to a terminus of the vertical lubricant guide bore 23 thereby to receive the lubricant oil from the vertical lubricant guide bore 23.

The upper surface of the support receiving portion 16 includes a substantially horizontal flat surface which receives the lock nut 20. The flat surface is formed with a lubricant feed groove 26 which extends substantially linearly in the front-back direction along a widthwise central portion of the flat surface. The flat surface is covered by the lock nut 20. The lubricant feed groove 26 communicates with the terminus of the horizontal lubricant guide bore 25 to receive the lubricant flowing through the horizontal lubricant guide bore 25 and to supply the lubricant to the lubricant guide path 27 as will be described later. The lubricant oil spouted outward during flowing from the horizontal lubricant guide bore 25 to the lubricant feed groove 26 is received by the flange 21, whereby the lubricant oil is prevented from being splashed around by the flange 21.

The upper surface of the support receiving portion 16 includes an inclined surface extending from the flat surface to the storage portion 17 with a falling gradient. The inclined surface includes a lubricant guide path 27 which is formed in a widthwise central portion of the inclined surface by beating the inclined surface using a press, so as to be depressed. The lubricant guide path 27 extends from the terminus of the lubricant feed groove 26 to an opening edge of the storage portion 17 or a receiving opening edge 33 which will be described later. The lubricant guide path 27 has a width that is gradually rendered larger as the lubricant guide path gets close to the widthwise central portion of the receiving opening edge 33. The lubricant guide path 27 is continuous to both sides sandwiching the same so as to be curved and has a curved section on the whole.

The opening edge of the storage portion 17 on the upper surface of the arm body 12 is defined by both sidewalls 14, the valve abutting portion 15 and the support receiving portion 16. More specifically, the opening edge of the storage portion 17 includes a pair of side opening edges 31 which constitute inner ends of both sidewalls 14 and are substantially parallel opposed to each other while retaining slight gaps between widthwise end surfaces of the roller 11 and the edges 31, respectively. The opening edge of the storage portion 17 also includes a front opening edge 32 which constitutes a rear edge of the valve abutting portion 15 and is substantially parallel opposed to a front end of the outer circumferential surface of the roller 11 except for both corners while retaining a slightly larger gap between the circumferential surface of the roller 11 and the front opening edge 32. The opening edge of the storage portion 17 further includes the receiving opening edge 33 which constitutes a front end of the support receiving portion 16 and is continuous to the terminus of the lubricant guide path 27 so that the lubricant flowing out of the lubricant guide path 27 is received by the receiving opening edge 33. Both corners of the front opening edge 32 and both end corners of the receiving opening edge 33 are formed into arc shapes with predetermined curvature radii respectively.

The receiving opening edge 33 of the storage portion 17 is formed into an undulate shape in a plan view and juts out into an angle shape so that both widthwise ends thereof are located away from the peripheral surface of the roller 11 and so that a widthwise central portion thereof comes closer to the peripheral surface of the roller 11. More specifically, the receiving opening edge 33 has a first widthwise central portion, and the outer circumferential surface of the roller 11 has a second widthwise central portion located opposite the aforesaid first widthwise central portion of the receiving opening edge 33. A distance between widthwise ends of the receiving opening edge 33 and widthwise ends of the outer circumferential surface of the roller 11 is set so as to be larger than a distance between the first and second widthwise central portions. Furthermore, the front opening edge 32 includes a third widthwise central portion, and the outer peripheral surface of the roller 11 also has a fourth widthwise central portion located opposite the aforesaid third widthwise central portion of the front opening edge 32. A distance between the third and fourth widthwise central portions is set so as to be longer than a distance between the first and second widthwise central portions. The lubricant guide path 27 has a terminus that extends from an apex of the receiving opening edge 33 to both skirt portions 36.

The above-described rocker arm 10 works as follows. When the rocker arm 10 is incorporated in the valve gear, the valve abutting portion 15 and the support receiving portion 16 of the arm body 12 are supported by the valve 83 and the pivot 70 respectively. The circumferential surface of the roller 11 is abutted on the peripheral surface of the cam 90. When the cam 90 is rotated in this state, the roller 11 is rotated while being pressed by the cam 90, so that the rocker arm 10 is swung with the support portion 71 of the pivot 70 serving as a fulcrum. With the swing of the rocker arm 10, the valve abutting portion 15 of the rocker arm 10 presses the valve 83 downward such that the valve 83 is opened. Upon further rotation of the cam 90, the valve 83 is released from the pressing force of the valve abutting portion 15, whereupon the valve 83 is pressed upward by the valve spring 84 into a closed state.

The lubricant flows through the lubricant supply hole 87 of the cylinder head 80 in the driving state of the engine. The lubricant flows through the inter-pivot lubricant guide hole 72, the vertical and horizontal lubricant guide bores 23 and 25 sequentially into the lubricant feed groove 26 of the support receiving portion 16. When the lubricant oil flows from the inter-pivot lubricant guide hole 72 to the vertical lubricant guide bore 23, a part of the lubricant oil lubricates the surfaces of the support portion 71 and the support receiving portion 16, thereby reducing the sliding resistance between the support portion 71 and the support receiving portion 16. The lubricant oil having flowed into the lubricant feed groove 26 further flows down along the lubricant guide path 27, thereafter going through the receiving opening edge 33 into the storage portion 17. In this case, since an apex 35 of the receiving opening edge 33 is in proximity to the circumferential surface of the roller 11, the lubricant oil having passed through the apex 35 desirably adheres to the widthwise central portion of the circumferential surface of the roller 11. When the peripheral surface of the cam 90 and the circumferential surface of the roller 11 are brought into sliding engagement with each other by further rotation of the roller 11, the lubricant oil are spread evenly from the widthwise central portion to both ends of the circumferential surface of the roller 11, whereupon the lubricant adheres to substantially the entire circumference of the roller 11. As a result, the lubricant oil lubricates the circumferential surface of the roller 11 and the peripheral surface of the cam 90, whereby the sliding resistance between the roller 11 and the cam 90 is reduced.

According to the foregoing embodiment, the opening edge of the storage portion 17 includes the receiving opening edge 33 receiving the lubricant oil. The receiving opening edge 33 is shaped so that both widthwise ends are spaced away from the circumferential surface of the roller 11. As a result, each widthwise end of the receiving opening edge 33 need not be formed so as to have a small radius. The embodiment differs from the conventional construction in this respect. Accordingly, the machining accuracy need not be improved, and the rocker arm 10 has better machining properties. Furthermore, the receiving opening edge 33 is further shaped so that the widthwise central portion thereof juts so as to come closer to the circumferential surface of the roller 11. Consequently, the lubricant oil can stably be supplied to the widthwise central portion of the circumferential surface of the roller 11. Accordingly, the lubricant oil spreads to both widthwise ends of the circumferential surface of the roller 11 with rotation of the roller 11, whereupon the lubricating property can be improved between the roller 11 and the cam 90.

Furthermore, since the lubricant guide path 27 is formed so as to be directed toward the widthwise central portion of the receiving opening edge 33, the lubricant oil evenly adheres to substantially the entire circumferential surface of the roller 11.

Furthermore, the lubricant feed groove 26 is formed in the upper surface of the support receiving portion 16 to guide the lubricant oil from the pivot 70 to the lubricant guide path 27. Consequently, the path along which the lubricant oil flows from the pivot 70 to the storage portion 17 can be constructed with high machinability.

Furthermore, the lubricant guide path 27 has a width that is gradually rendered larger as the lubricant guide path gets close to the widthwise central portion of the receiving opening edge 33. Consequently, the lubricant oil smoothly flows along the lubricant guide path 27 without forming an oil reservoir.

Still furthermore, the lubricant guide path 27 is formed so as to be recessed into a curved shape by beating the upper surface of the arm body 12. Consequently, the machinability can further be improved and in addition, the stiffness and durability of the rocker arm can be improved.

In the foregoing embodiment, the path of the lubricant oil flowing to the storage portion should not be limited to the above-described path. The lubricant oil may or may not flow through the lubricant supply hole 87, the inter-pivot lubricant guide hole 72, the vertical and horizontal lubricant guide bores 23 and 25, the lubricant feed groove 26 and the lubricant guide path 27. Furthermore, the lubricant guide path 27 may be formed by cutting the upper surface of the arm body 12. Additionally, a lash adjuster may serve as a swing fulcrum of the rocker arm 10, instead of the pivot 70.

The foregoing description and drawings are merely illustrative of the principles and are not to be construed in a limiting sense. Various changes and modifications will become apparent to those of ordinary skill in the art. All such changes and modifications are seen to fall within the scope as defined by the appended claims.

What is claimed is:

1. A rocker arm for an internal combustion engine, comprising:

a roller brought into contact with a cam thereby to be rotated; and an arm body having a storage portion in which the roller is stored, the arm body being swung by rotation of the cam, thereby opening and closing a valve, wherein the storage portion has an opening edge located on an upper surface of the arm body and opposed to a circumferential surface of the roller, and the opening edge includes a part receiving lubricant oil flowing along the upper surface of the arm body, said part being formed with a receiving opening edge jutting out so that both widthwise ends thereof are located away from the circumferential surface of the roller and so that a widthwise central portion thereof comes closer to the circumferential surface of the roller; and wherein the arm body has a lubricant guide path which is formed by recessing the upper surface thereof and guides the lubricant oil into the storage portion, the lubricant guide path having a width that is gradually rendered larger as the lubricant guide path gets close to the widthwise central portion of the receiving opening edge.

2. The rocker arm according to claim 1, wherein both end corners of the receiving opening edge are each formed into an arc shape with a predetermined curvature radius.

3. The rocker arm according to claim 1, wherein the opening edge of the storage portion has another opening edge located opposite the receiving opening edge, and a distance between a widthwise central portion of said another opening edge and a widthwise central portion of the circumferential surface of the roller opposed to the widthwise central portion of said another opening edge is set so as to be larger than a distance between the widthwise central portion of the receiving opening edge and the widthwise central portion of the circumferential surface of the roller opposed to the widthwise central portion of the receiving opening edge.

4. The rocker arm according to claim 1, wherein the lubricant guide path is formed into an inclined surface having a falling gradient so as to be directed toward the receiving opening edge.

5. The rocker arm according to claim 1, wherein the lubricant guide path is formed so as to be recessed into a curved shape by beating the upper surface of the arm body.

6. The rocker arm according to claim 1, wherein the arm body has front and back sides with the storage portion being located therebetween, the front and back sides being formed with a valve abutting portion which abuts on the valve and a support receiving portion which receives a support member supporting the arm body so that the arm body is swingable, the support receiving portion having an upper surface formed with a lubricant feed groove which guides the lubricant oil from the support member to the lubricant guide path.

7. The rocker arm according to claim 6, wherein the upper surface of the support receiving portion includes a substantially flat surface in which the lubricant feed groove is formed.

8. The rocker arm according to claim 6, wherein the lubricant feed groove is formed so as to extend substantially linearly in a front-back direction.

9. The rocker arm according to claim 6, wherein the support member is formed with a vertical lubricant guide bore extending vertically and a horizontal lubricant guide bore extending in a direction perpendicular to the vertical lubricant guide bore, the horizontal lubricant guide bore having a terminus which communicates with the lubricant feed groove.

10. The rocker arm according to claim 1, wherein the lubricant guide path has a curved shape recess.

* * * * *